US011542811B2

(12) United States Patent
Johanis et al.

(10) Patent No.: US 11,542,811 B2
(45) Date of Patent: Jan. 3, 2023

(54) PROCESSING HYDROCARBON PRODUCTION DATA TO CHARACTERIZE TREATMENT EFFECTIVENESS AND LANDING ZONES

(71) Applicant: Landmark Graphics Corporation, Houston, TX (US)

(72) Inventors: Pablo Esteban Johanis, Buenos Aires (AR); Jose Rafael Vielma, Buenos Aires (AR); Santiago Miguel Casala, Buenos Aires (AR)

(73) Assignee: Landmark Graphics Corporation, Houston, TX (US)

( * ) Notice: Subject to any disclaimer, the term of this patent is extended or adjusted under 35 U.S.C. 154(b) by 199 days.

(21) Appl. No.: 16/961,993

(22) PCT Filed: Aug. 14, 2019

(86) PCT No.: PCT/US2019/046508

§ 371 (c)(1),
(2) Date: Jul. 14, 2020

(87) PCT Pub. No.: WO2021/029887

PCT Pub. Date: Feb. 18, 2021

(65) Prior Publication Data

US 2022/0003113 A1 Jan. 6, 2022

(51) Int. Cl.
*E21B 47/10* (2012.01)
*E21B 43/16* (2006.01)

(52) U.S. Cl.
CPC ..... *E21B 47/10* (2013.01); *E21B 43/16* (2013.01)

(58) Field of Classification Search
CPC ..... E21B 47/10; E21B 43/16; E21B 43/26; E21B 2200/20; G06Q 50/02
See application file for complete search history.

(56) References Cited

U.S. PATENT DOCUMENTS

2009/0194274 A1* 8/2009 Castillo ..... E21B 43/00 166/250.01
2016/0177679 A1* 6/2016 Zhang ..... E21B 41/0092
(Continued)

FOREIGN PATENT DOCUMENTS

EP 3406844 A1 11/2018

OTHER PUBLICATIONS

Pankaj et al.; "Evaluating the Impact of Lateral Landing, Wellbore Trajectory and Hydraulic Fractures to Determine Unconventional Reservoir Productivity"; Society of Petroleum Engineers; 2018; 33 pages.

(Continued)

*Primary Examiner* — Tarun Sinha
*Assistant Examiner* — Lal C Mang
(74) *Attorney, Agent, or Firm* — Kilpatrick Townsend & Stockton LLP

(57) ABSTRACT

A computer system and method for analyzing effectiveness of applied treatments or characterizing landing zones. The method includes, for respective one or more wells, receive production data, determining oil, gas, and/or water production data from the production data, determining an effective fluid production time for production of the oil and/or gas, combining the oil, gas, and/or water production data per to obtain a fluid production per time interval, calculate a fluid production rate per time interval as a function of the effective fluid production time and the fluid production of the time interval, and normalize the fluid production rate per time interval using a normalization factor that is available in the production data received. The method further includes analyzing effectiveness of treatments applied to one of the wells using the well's normalized fluid production rate associated with the plurality of time intervals.

20 Claims, 5 Drawing Sheets

(56) References Cited

U.S. PATENT DOCUMENTS

| | | | | |
|---|---|---|---|---|
| 2016/0260181 | A1 | 9/2016 | Singh | |
| 2017/0114617 | A1* | 4/2017 | Fulford | E21B 41/0092 |
| 2017/0364795 | A1* | 12/2017 | Anderson | G06N 3/08 |
| 2018/0202264 | A1 | 7/2018 | Sarduy et al. | |
| 2019/0120022 | A1 | 4/2019 | Zanon et al. | |

OTHER PUBLICATIONS

Wang et al.; "Flow Rate Behavior and Imbibition Comparison Between Bakken and Niobrara Formations"; Unconventional Resources Technology Conference; 2014; 13 pages.

Noguera et al.; "Multi-Disciplinary Approach for a Landing point Criteria in Vaca Muerta Formation"; Unconventional Resources Technology Conference; 2017; 18 pages.

Yu et al.; "Normalization of Analog Horizontal Wells for Type Curve Generation in Tight Gas Plays"; Society of Petroleum Engineers; 2015; 22 pages.

International Search Report and Written Opinion for PCT Application No. PCT/US2019/046508 dated May 13, 2020, 9 pages.

* cited by examiner

PROCESSING HYDROCARBON PRODUCTION DATA TO CHARACTERIZE TREATMENT EFFECTIVENESS AND LANDING ZONES

TECHNICAL FIELD

The embodiments disclosed herein generally relate to an improved data processing system and in particular, to a method and apparatus for analyzing hydrocarbon production data.

BACKGROUND

Operations, such as geophysical surveying, drilling, logging, well completion and production, are typically performed to locate and gather valuable downhole fluids. Surveys are often performed using acquisition methodologies, such as seismic mapping, resistivity mapping, etc. to generate images of underground formations. These formations are often analyzed to determine the presence of subterranean assets, such as valuable fluids or minerals, or to determine if the formations have characteristics suitable for storing fluids. The production of hydrocarbon and the stimulation design is historically based upon intrinsic properties of the rock such as petrophysical properties, lithology and age.

The productivity of a horizontal well can further be affected by treatments applied to the well using technological interventions during drilling, completion and stimulation, such as fluid injection, chemical treatments, choke management, and/or artificial lift, refracturing. The effectiveness of different treatments can be analyzed by comparing the production success at wells having similar properties to which the treatments were applied, respectively. This knowledge is important for selecting and/or controlling treatments for optimizing production. However, productivity of a well and effectiveness of treatments to the well can only be studied when meaningful information about the well's productivity is available.

For proprietary or governmental regulation reasons, information about the productivity of many horizontal wells is not available. While production data for various wells may be available from public domain sources, the information is unstandardized, and therefore has limited meaningful value. While it may be desirable to normalize such production information by factors, such as stimulated lateral length (i.e., longitude of a low angle section of the well placed within a reservoir), number of stages (i.e., respective steps in which a hydraulic fracture operation is organized, by stimulating a section of the lateral length placed between two successive well plugs), volume of proppant, etc., however, such factors are typically not available, such as due to proprietary or government regulation reasons, thwarting the ability to normalize using such factors.

Also of interest is the ability to correlate production information to identified landing zones for the purpose of analyzing the effectiveness of treatments to different landing zones. However, systematic reporting of landing zones can be lacking. Landing zones are organic enriched zones that can develop in single or stacked multilayer pads in shale reservoirs. Detailed characterization parameters of landing zones can be closely related to identification of small order stratigraphic sequences and classic sets of reservoir characterization features. However, unless disclosed with production data, or inferred by well geometry and structural framework, identification landing zone may not be readily available. This disclosure proposes a ratio between fluid production rates which may characterize parameters of landing zones.

BRIEF DESCRIPTION OF THE DRAWINGS

For a more complete understanding of the disclosed embodiments, and for further advantages thereof, reference is now made to the following description taken in conjunction with the accompanying drawings in which.

DETAILED DESCRIPTION

Figure 1:
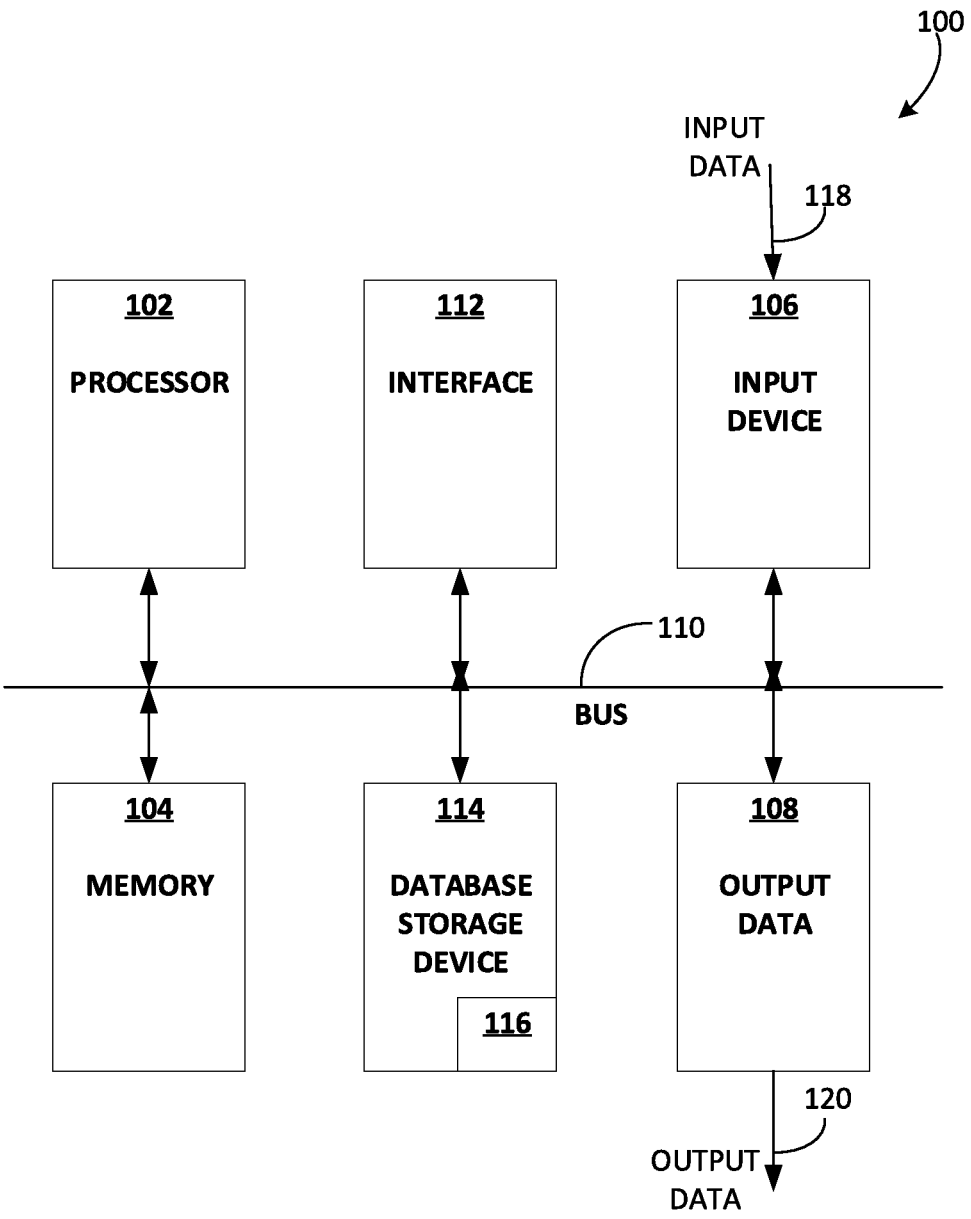
FIG. 1 is a block diagram illustrating an example computer system, components of which are used with embodiments of the present disclosure.

The illustrated embodiments are now described more fully with reference to the accompanying drawings wherein like reference numerals identify similar structural/functional features. The illustrated embodiments are not limited in any way to what is illustrated as the illustrated embodiments described below are merely exemplary, which can be embodied in various forms, as appreciated by one skilled in the art. Therefore, it is to be understood that any structural and functional details disclosed herein are not to be interpreted as limiting, but merely as a basis for the claims and as a representation for teaching one skilled in the art to variously employ the discussed embodiments. Furthermore, the terms and phrases used herein are not intended to be limiting but rather to provide an understandable description of the illustrated embodiments.

Unless defined otherwise, all technical and scientific terms used herein have the same meaning as commonly understood by one of ordinary skill in the art to which this present disclosure belongs. Although any methods and materials similar or equivalent to those described herein can also be used in the practice or testing of the illustrated embodiments, exemplary methods and materials are now described.

It must be noted that as used herein and in the appended claims, the singular forms "a", "an," and "the" include plural referents unless the context clearly dictates otherwise. Thus, for example, reference to "a stimulus" includes a plurality of such stimuli and reference to "the signal" includes reference to one or more signals and equivalents thereof known to those skilled in the art, and so forth.

It is to be appreciated the illustrated embodiments discussed below are preferably a software algorithm, program or code residing on computer useable medium having control logic for enabling execution on a machine having a computer processor. The machine typically includes memory storage configured to provide output from execution of the computer algorithm or program.

As used herein, the term "software" is meant to be synonymous with any code or program that can be in a processor of a host computer, regardless of whether the implementation is in hardware, firmware or as a software computer product available on a disc, a memory storage device, or for download from a remote machine. The embodiments described herein include such software to implement the equations, relationships and algorithms described above. One skilled in the art will appreciate further features and advantages of the illustrated embodiments based on the above-described embodiments. Accordingly, the illustrated embodiments are not to be limited by what has been particularly shown and described, except as indicated by the appended claims.

The illustrated embodiments further relate to guiding, controlling, and/or monitoring exploration or drilling subterranean operations using a result of processing the production data.

It will be understood that the terms screening, exploration, and/or subterranean drilling are not intended to limit the use of the structures and processes described in connection with those terms to a particular type of hydrocarbon or exploration of a particular subterranean environment, as the illustrated embodiments of the present disclosure encompass screening, exploration, and/or drilling of any suitable subterranean environment, including, but not limited to any geologic environment that includes a sedimentary basin, a seabed, a reservoir, one or more fractures, etc. The terms also encompass screening, exploration, and/or drilling for natural gas wells or hydrocarbon wells in general. Further, such wells can be used for drilling, production, monitoring, or injection in relation to the recovery of hydrocarbons or other materials from the subsurface. This could also include geothermal wells intended to provide a source of heat energy instead of hydrocarbons.

As will be appreciated, the illustrated embodiments generally consist of a computer system and method for analyzing effectiveness of applied treatments or characterizing parameters of landing zones. For each of one or more wells production data associated with a plurality of time intervals is received and oil, gas, and/or water production data is determined from the production data for the respective time intervals. The effective fluid production time per time interval of the plurality of time intervals is determined. The oil, gas, and/or water production data are combined per time interval to obtain interval fluid production. An interval fluid production rate is calculated as a function of the effective time for the respective time intervals. The interval fluid production rate is normalized for the time intervals using a normalization factor that is available in the production data. Effectiveness of applied treatments to the well can be analyzed using the normalized interval fluid production rate.

A peak fluid production rate can be determined for respective time intervals of the plurality of time intervals, wherein the normalization factor can be the peak fluid production rate.

Turning now descriptively to the drawings, in which similar reference characters denote similar elements throughout the several views, FIG. 1 depicts an exemplary computing system in which below illustrated embodiments may be implemented.

A generalized computing embodiment in which the illustrated embodiments can be realized is depicted in FIG. 1 illustrating a processing system 100 that may be used (or components thereof) with one or more embodiments described herein, e.g., as one of the components shown in the below described system 200 including one or more hydrocarbon production data analysis systems.

Processing system 100 generally consists of at least one processor 102, or processing unit or plurality of processors, memory 104, at least one input device 106 and at least one output device 108, coupled together via a bus or group of buses 110. In certain embodiments, input device 106 and output device 108 can be the same device. An interface 112 can also be provided for coupling the processing system 100 to one or more peripheral devices. For example, interface 112 could be a PCI card or PC card. At least one storage device 114 which houses at least one database 116 can also be provided.

The memory 104 can be any form of memory device, for example, volatile or non-volatile memory, solid-state storage devices, magnetic devices, etc. The processor 102 can comprise more than one distinct processing device, for example to handle different functions within the processing system 100.

Input device 106 receives input data 118 and can comprise, for example, a keyboard, a pointer device such as a pen-like device or a mouse, audio receiving device for voice controlled activation such as a microphone, data receiver or antenna such as a modem or wireless data adaptor, data acquisition card, etc. Input data 118 can come from different sources, for example keyboard instructions in conjunction with data received via a network.

Output device 108 produces or generates output data 120 and can comprise, for example, a display device or monitor in which case output data 120 is visual, a printer in which case output data 120 is printed, a port for example a USB port, a peripheral component adaptor, a data transmitter or antenna such as a modem or wireless network adaptor, etc. Output data 120 can be distinct and derived from different output devices, for example a visual display on a monitor in conjunction with data transmitted to a network. A user could view data output, or an interpretation of the data output, on, for example, a monitor or using a printer. The storage device 114 can be any form of data or information storage means, for example, volatile or non-volatile memory, solid state storage devices, magnetic devices, etc.

In use, the processing system 100 is adapted to allow data or information to be stored in and/or retrieved from, via wired or wireless communication means, at least one database 116. The interface 112 may allow wired and/or wireless communication between the processing unit 102 and peripheral components that may serve a specialized purpose. Preferably, the processor 102 receives instructions as input data 118 via input device 106 and can display processed results or other output to a user by utilizing output device 108. More than one input device 106 and/or output device 108 can be provided. It should be appreciated that the processing system 100 may be any form of terminal, server, specialized hardware, or the like.

It is to be appreciated that the processing system 100 may be a part of a networked communications system. Processing system 100 could connect to a network, for example the Internet or a WAN. Input data 118 and output data 120 can be communicated to other devices via the network. The transfer of information and/or data over the network can be achieved using wired communications means or wireless communications means. A server can facilitate the transfer of data between the network and one or more databases. A server and one or more databases provide an example of an information source.

Thus, the processing system 100 illustrated in FIG. 1 preferably operates in a networked environment using logical connections to one or more remote computers, servers and/or databases. The remote computer may be a personal computer, a tablet device, smart phone device, a server, a router, a network PC, a peer device, or other common network node, and typically includes many or all of the elements described above.

It is to be further appreciated that the logical connections depicted in FIG. 1 include a local area network (LAN) and a wide area network (WAN), but may also include other networks such as a personal area network (PAN). Such networking environments are commonplace in offices, enterprise-wide computer networks, intranets, and the Internet. For instance, when used in a LAN networking environment, the processing system 100 is connected to the LAN through a network interface or adapter. When used in a WAN networking environment, the computing system environment typically includes a modem or other means for establishing communications over the WAN, such as the Internet. The modem, which may be internal or external, may be connected to a system bus via a user input interface, or via another appropriate mechanism. In a networked environment, program modules depicted relative to the processing system 100, or portions thereof, may be stored in a remote memory storage device. It is to be appreciated that the illustrated network connections of FIG. 1 are exemplary and other means of establishing a communications link between multiple computers may be used.

Figure 2:
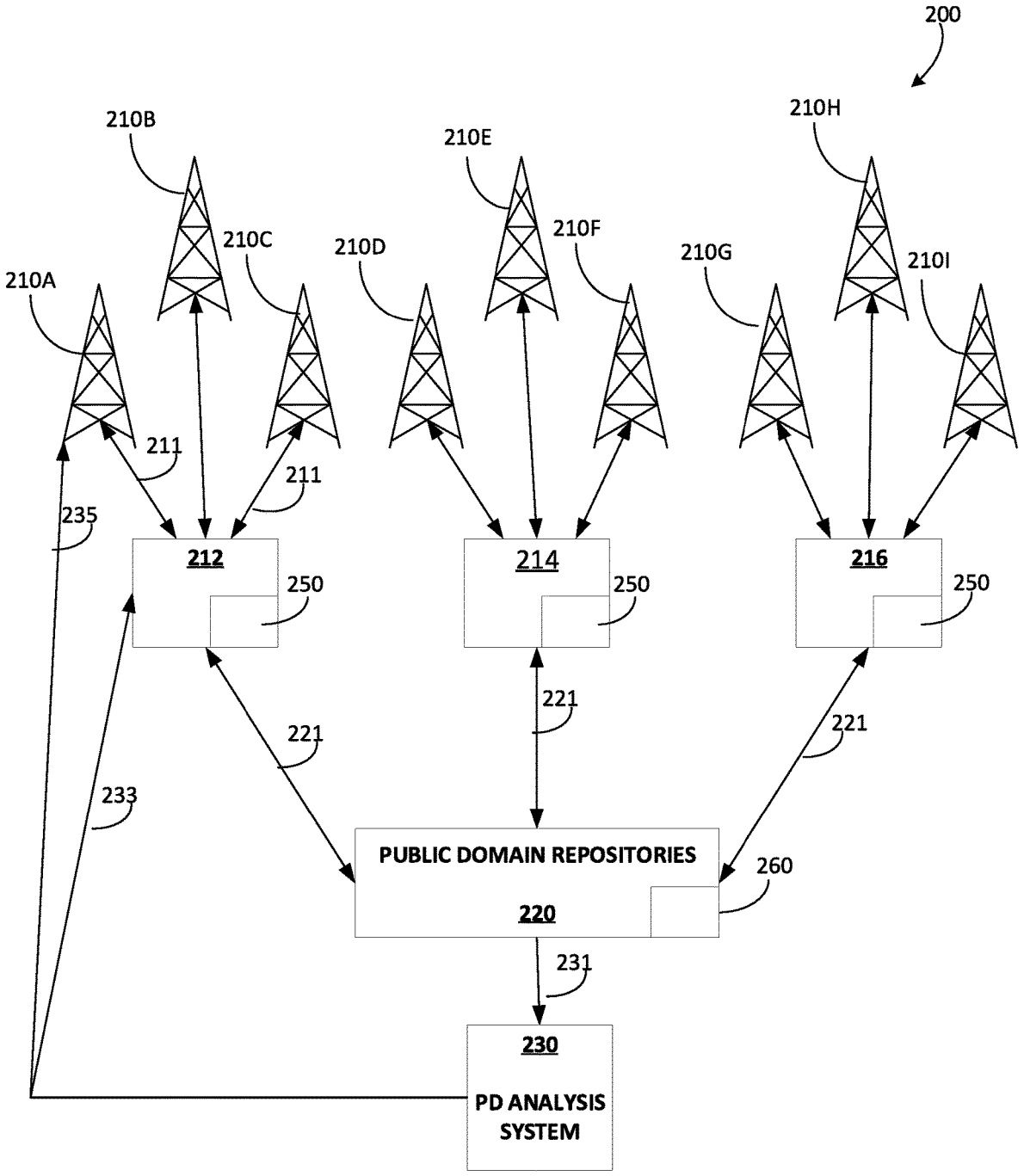
FIG. 2 is a system level diagram illustrating example components of an illustrated embodiment communicatively coupled to a plurality of wells.

FIG. 2 is a schematic block diagram of an example hydrocarbon production analysis system 200 in accordance with an illustrated embodiment includes a plurality of private analysis and storage systems 212-216 (e.g., computer processor, database, memory and the like) that generate, receive, analyze, and/or store private production data (PD) series as private data 250 associated with production performed by wells 210. Private systems 212-216 can provide selected data from the private data 250 as public data 260 to public domain repositories 220. A PD analysis system 230 is provided to access and analyze the public data 260 to obtain meaningful information. In embodiments, PD analysis system 230 is networked to the public domain repositories 220 for obtaining public data 250.

PD analysis system 230 as well as private systems 212-216 and/or public repository 220 incorporate one or more components of above described processing system 100. As explained above, in different embodiments these various devices are configured to communicate with each other in any suitable way, such as, for example, via a communication network such as the Internet. System 200 is only one example of a suitable system and is not intended to suggest any limitation as to the scope of use or functionality of the illustrated embodiments described herein. Regardless, system 200 is capable of being implemented and/or performing any of the functionality set forth herein.

Wells 210, referred to generically by reference numeral 210, are shown as examples of diverse individual wells, referred to as wells 210A-2101. In the example shown, wells 210A-210C communicate with private system 212 as a first proprietary system, wells 210D-210F communicate with private system 214 as a second proprietary system, and wells 210G-2101 communicate with private system 216 via communications links as a third proprietary system, where the communication links can include wired and wireless links. The number of wells 210, private systems 212-216 and distribution of wells 210 to private systems 212-216 is for illustrative purposes only and is not limited to the illustrated scenario.

The wells 210 of each proprietary system can be located in a similar vicinity, e.g., for drilling in association with the same reservoir, or can be located in a different vicinity, e.g., for drilling in association with different reservoirs. The different reservoirs can be in different geographic regions, including in different states or provinces of the same country or in different countries. Each of private systems 212-216 can include an onsite data receiver that that can collect and/or process private data 150, including in real-time, during, before, or after a drilling operation, an offsite data receiver that receives private data 150 from one or more onsite data receivers (e.g., in realtime or in batches), and/or one or more distributed or centralized processing systems that receive private data 150 from onsite or offsite data receivers. Components configured such as processing system 100 can be used at the various stages of data collection and processing (onsite, offsite, distributed or centralized).

The private systems 212, 214, 216 can each gather and/or process private data 150 about drilling, completion, and stimulation its associated wells 210 using techniques proprietary to that private system 212, 214, 216. Some of the private data 150 received or processed by components of the private systems 212, 214, 216 are intended to be maintained private by the corresponding private system 212, 214, 216.

The proprietary systems can be owned and/or controlled, for example, by a private business entity or a government entity. Private business entities are governed by regulations of one or more jurisdictions, such as the jurisdiction of the location of the well, the location of data operations, and/or the residence of the owning and/or controlling entity.

Private systems 212, 214, 216 may release selected information to public domain repositories 220 for release to the public, such as due to jurisdictional requirements, publicity, research, etc. Even when information is released to the public by a private system 212, 214, 216, the information can be non-standardized (such as due to the different techniques used to collect and process data). Without access to proprietary information about how the data was gathered and/or processed before public release, the information can have limited meaning, if any.

Public data 260 refers to information that the proprietary systems have provided to public domain repositories 220, e.g., via private systems 212-216. The production data is public data that has been made available for public access and is not encumbered as being private data or regulated data that is not available to the public. The public data 260 from different proprietary systems can be unstandardized, and therefore have limited meaningful value. The public data 260 can include production data about production of hydrocarbons, including various types of data about production of different wells. The production data can include, for example, logs of monthly production of each of gas, oil, and water. Columns of data, each column corresponding to a different production amount, can be included in public data 260. When publishing this data, different units can be used for the different types of data, including for production of different types of fluid.

If normalized, the production data can be normalized using proprietary production information, such as stimulated lateral length, number of stages, volume of proppant, etc., which are not included in the public data 260, such as due to its proprietary nature and/or government regulation. Meaningfulness of the production data is reduced when there is no access to the normalization factor that is used to normalize the production data. Additionally, information, such as choke valve opening, wellhead pressure, bottomhole pressure, temperature, produced fluid viscosity, are not included in the public data 260, which can reduce or obstruct the ability to perform detailed analysis on the production data. The present disclosure describes how PD analysis system 230 can access and analyze the public data 260 to obtain meaningful information and allow for detailed analysis.

Further lacking in the public data 260 is systematic reporting of landing zones. Inconsistent reporting of landing zones can include a categorical reference to a productive formation or landing zone. In other cases, a combined analysis of well geometry and structural framework (if such knowledge is available) can allow for some degree of inference of landing zones.

However, the use of multiple local stratigraphic schemes or nomenclatures in the public data 260 to define the landing zone instead of a single common regional key can lead to difficulties when integrating data. Additionally, the definition of landing zones based on seismic interpretation in time domain could be problematic to integrate with interpretations in depth domain.

It is a common practice for the public data 260 to report commingled production in certain monthly production data reports, wherein comingled production includes output from different production levels that is presented as being output from only the most productive of the multiple levels. The present disclosure describes how PD analysis system 230 can isolate the commingled cases as anomalies when compared against single productive interval cases.

The subterranean operations at the wells 210 and/or exploration for wells 210 can be guided, controlled, performed, monitored and/or processed by the PD analysis system 230.

Figure 3:
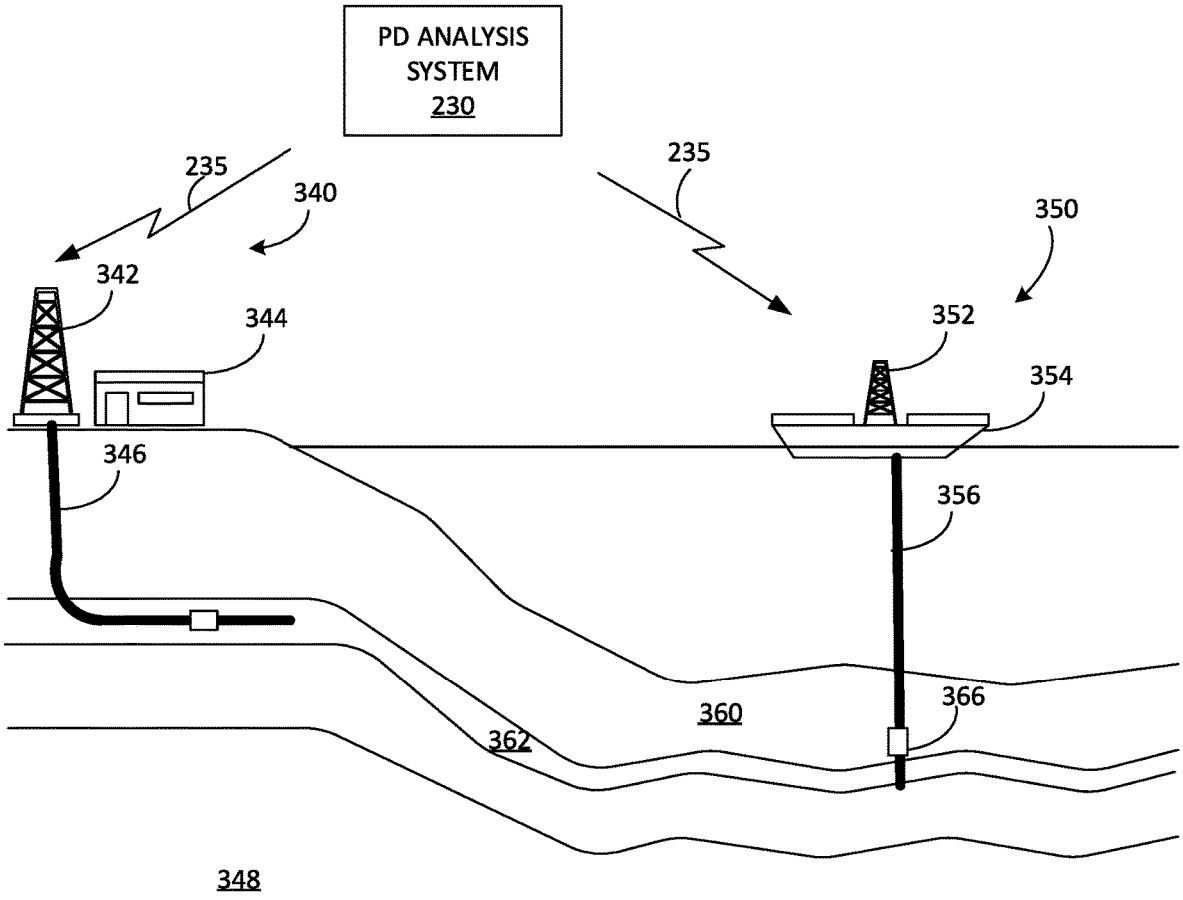
FIG. 3 is a block diagram of an example production data analysis system of the computer system as provided in an example operating environment.

With reference to FIG. 3, these subterranean operations may take place at an onshore location or site 340 as well as an offshore location or site 350. The onshore site 340 may have a rig 342 and a rig control system 344, among other things. The rig control system 344 may be used to operate the rig 342 to perform one or more of the subterranean operations. These subterranean operations may include rotating a drill string 346 to drill through a subterranean formation 348. Likewise, the offshore site 350 may have, among other things, a rig 352 mounted on a drill ship 354. The drill ship 354 may be used to operate the rig 352 to perform one or more of the subterranean operations, such as rotating a drill string 356 to drill through the subterranean formation 348.

The subterranean formation 348 may include one or more strata or layers, one which is indicated at 360. These layers 360 may include a hydrocarbon reservoir 362, among other things. Various sensor packages 364 may be mounted on the drill string 346 of the rig 342 to obtain data about these layers 360. Similar sensor packages 366 may be mounted on the drill string 356 of the rig 352 to obtain data about the various layers 360. Although not expressly shown, one or more sensor packages may be located on or near the surface of the formation 348 instead of or in addition to the drill strings 346, 356. The various sensor packages 364, 366 may include seismic sensors, electromagnetic sensors, temperature sensors, pressure sensors, depth sensors, and other sensors known to those skilled in the art.

A portion of the drill string 346, 356 may be operated to drill horizontally through the layers 360 in some cases in order to access the hydrocarbon reservoir 362. In such horizontal drilling operations (and other operations), lateral variations in formation properties (which can be mainly total organic content, porosity, permeability, fluids saturation changes along the horizontal section of the well), stresses (e.g., pore pressure and fracture gradient), and other formation properties need to be assessed and analyzed by the PD analysis system 230 in order to assist with planning and executing the operations. Communication between the PD analysis system 230 and the onshore site 340 and onshore site 350, indicated respectively at 368 and 370, may be accomplished using any communication protocols known to those skilled in the art, including landline protocols, cellular protocols, as well as satellite protocols.

With returned reference to FIG. 2, PD analysis system 230 is configured to access the public data 260 and process selected information from the public data 260 in a way that increases meaning of the public data 260 and its usefulness. One goal is to normalize the public data 260 using a consistent normalization factor for the public data 260, regardless of the data source, using a normalization factor that is available in the production data itself. Another goal is to use the public data 260 for systematic landing zone parameter characterization.

With regard to normalization of the production data included in the public data 260, the PD analysis system 230 uses a peak rate, such as a peak fluid production rate, as a normalization factor for the production data.

Other options that could be used as a normalization factor based on information included in the public data 260 include, for example and without limitation, peak hydrocarbon rate, a single fluid rate (such as peak water rate, peak oil rate, or peak gas rate), indexes derived from ratios of rates or cumulative amounts for oil, gas, water, hydrocarbons and/or fluids, or a mathematical derivation of such rates or cumulative amounts.

Relative to other options for the normalization factor, peak fluid production rate can have advantages, such as when applied to a data universe that includes different landing zones.

The PD analysis system 230 can determine the peak fluid production rate by roughly assuming the peak fluid production rate to be the maximum fluid that a well could theoretically output using data that is available in public data 260. The peak fluid production rate will be influenced by the techniques used for drilling, completion, and stimulation, reservoir characteristics of the well, and production method used. By calculating rates, such as fluid production rates and hydrocarbon production rates, using data that is available in public data 260, and normalizing these rates using the peak fluid production rate, the calculated rates become dimensionless, as a fraction of the maximum possible. A decline from the maximum possible, or an incline to the maximum possible, can be clearly indicated by a series of the normalized calculated rates.

Fluid production rates (e.g., for a combination of fluids, which can include oil, gas, and/or water) can be obtained using monthly fluid production values and using monthly effective times that are included in the monthly data. The maximum value that can be determined or interpolated for the fluid production rates is the peak fluid production rate.

By normalizing the fluid production rates or hydrocarbon production rates using the peak rate, all of which is based on the public data 260 without data from additional sources that might not be available to the public (such as a stimulation database or a lateral length report) standardized rate information can be generated that was not available without access to proprietary information. Standardized rate information from the same or different sources of public data 260 enables the ability to compare rate information associated with different wells. Comparing public data 260 associated with the different wells can include ranking the wells. The comparison and/or ranking can be used to evaluate effectiveness of technologies, methodologies, or processes applied to the respective wells.

Such technologies refer to methods, systems, and devices which use scientific knowledge for practical purposes. In an example of such a technology, a fiber optic well monitoring installation, including a fiber optic sensor placed along the well to register sound and temperature, can be used to monitor the well's behavior, stage by stage, from completion to production, along its entire lifecycle.

Such methodologies refer to methods, rules and postulates employed by a discipline, such as for a particular procedure or set of procedures. In an example of such a methodology, a perforation (perf) and plug completion method entails the placement or pumping down of a plug and perf gun to a desired stage in a well bore. Once the plug is set, the perf gun fires holes in the casing, penetrating the reservoir section between the set plugs.

Such processes refer to a series of actions which are carried out in order to achieve a particular result. In an example of such a process, details are recorded in a hydraulic fracture chart, wherein the details result from a series of instructions to increase, sustain and decrease pumping pressure and concentration of proppant in accordance with a hydraulic fracture design plan.

Furthermore, evaluation of the effectiveness of technologies, methodologies, or processes can be used to effect a state of change, such as for selecting, guiding, monitoring, and/or controlling application of technologies, methodologies, and/or processes to apply to a well associated with a landing zone, including for screening, exploration, and/or subterranean drilling. Non-limiting examples of effecting a state of change include shifting from vertical wells to horizontal wells, lengthening laterals, adjusting density in completion (less space between perforations and between perforation clusters), adjusting well trajectory design, with a tendence to smoother curves, effecting tendence to inject more proppant in hydraulic fracture, effecting tendence to use more natural sands, effecting tendence to use finer mesh sands, effecting tendence to use less or more slickwater fluids and/or less gels, changing millable plugs to/from dissolvable plugs, shifting between sleeves and perf and plug, managing choke to produce at lower wellhead pressure, and controlling duration of well shut-ins to favor injected water soaking and imbibition.

Many trials and assays can be performed and compared in order to effect such a change. Normalization of production curves is a critical factor for comparing trial and assay results and selecting a change to effect.

Characterization of a landing zone enables prediction of its production range and relative production of water and hydrocarbons. A possible consequence of such prediction when developing field plans would be prediction of a volume of produced water that is available, which influences quantification of injection wells. Some non-limiting examples of changes that can be effected based on landing zone characterization include adjusting an amount of production water in hydraulic fracturing by controlling injection wells, managing soaking times to favor or hinder imbibition processes, setting injection pressure during hydraulic fracturing to match or largely surpass capillary forces, and selecting use of specific emulsifiers and surfactants.

Even when proprietary information is available, it is complicated to normalize and standardize production data associated with application of different technologies, methodologies, or processes. The public data 260 can include implied or explicit peak rate information (wherein the explicit peak rate information was measured or derived from the other public data). Calculation of or access to the peak rate information and normalization of rate information using the peak rate information provides a simplified method of standardizing rate information of different wells, without regard to the technology, methodology, or process used.

With reference to characterization of parameters of landing zones, oil saturation has been used previously for characterizing quality of a landing zone, however determination of oil saturation is challenging and non-uniform. A procedure, such as injection of water, may be used to determine oil saturation. The results of the non-uniform procedures are also non-uniform.

A method for characterizing one or more parameters of landing zones is disclosed herein that uses a ratio of different fluid peak rates using public data 260. This ratio, unlike oil saturation, provides a relationship that can be expressed as a standardized, single, fixed, diachronic parameter.

The ratio associated with a particular well describes a relationship between maximum fluid production rate and maximum hydrocarbon production rate produced during the life of the well. Other options for the as a ratio include a ratio formed of two different factors selected from, for example and without limitation, peak hydrocarbon rate, a single fluid rate (such as peak water rate, peak oil rate, or peak gas rate), indexes derived from ratios of rates or cumulative amounts for oil, gas, water, hydrocarbons and/or fluids, or a mathematical derivation of such rates or cumulative amounts.

Fluid production rates (e.g., for a combination of fluids, which can include oil, gas, and/or water) can be obtained using monthly fluid production values and using monthly effective times that are included in the monthly data. Similarly, hydrocarbon production rates can be obtained using monthly hydrocarbon production values and using monthly effective times that are included in the monthly data. The maximum value that can be determined or interpolated for each of the fluid production rates and hydrocarbon production rates is the peak fluid production rate and peak hydrocarbon production rate, respectively. Sometimes the peak fluid production rate and peak hydrocarbon production rate coincide in the same month. In other cases, the peak fluid production rate and peak hydrocarbon production rate occur in different months. Regardless of the timing, a ratio of these two peak rates provides a value in which engineering-related variables common to both the numerator and the denominator are cancelled out. Variables that can be cancelled include, for example, lateral length, number of stages, perforation and clusters spacing (e.g., the distance that separates groups of perforations along a completion stage), volume and type of fluids and proppant injected for stimulation, etc.

Due to the standardized ratio that is unaffected by such canceled-out engineering-related variables, a relationship between ratios obtained for wells and landing zones associated with the respective wells can thus be analyzed. Based on this relationship, once a ratio is determined for a well, the relationship can be used to characterize the landing zone associated with the well, and the characterization can be used to analyze parameters associated with the landing zone.

The interpretation of the ratio for characterizing parameter(s) of the associated landing zone can be performed using only public data and can be performed by a person unskilled in the geosciences domain. This is unlike current methods for characterizing parameter(s) of landing zones that use complex and/or proprietary data about the well and its production, and further requires analysis by a person highly skilled in the geosciences domain.

The characterization of a landing zone can be useful for predicting relative production of water and hydrocarbons, such as monthly oil, gas, and/or water production volumes and rates. These characterizations of landing zones can be mapped, which can be helpful for identifying areas of higher productivity and areas of less productivity that have relatively more water-bearing potential. The monthly produced oil, gas, and/or water volumes and rates and their interrelation have a characteristic value distribution by landing zone and describe patterns when mapped that indicate areas of higher productivity or relatively more water-bearing potential.

In addition, parameters associated with an individual landing zone having a set of landed wells can be analyzed in view of the landing zone's characterization. These parameters can also be used for predicting relative production of water and hydrocarbons. Some examples, without limitation, of such parameters include geological parameters, such as lithofacies and a depositional environment; petrophysical modeling parameters, such as average total organic content, average effective porosity, and permeability; geomechanical parameters, such as Poisson's modulus, Young's coefficient, and a derived brittleness index; and seismic parameters, such as average acoustic impedance.

These parameters can be determined and analyzed, such as to include a range of parameters or a trend of parameters in an offset curve or a cross plot or to otherwise analyze the parameters. Determination of the ratio, as well as analysis of parameters determined using the ratios, can be used to effect a state of change, such as for selecting, guiding, monitoring, and/or controlling application of technologies, methodologies, and/or processes to apply to a well associated with a landing zone, including for screening, exploration, and/or subterranean drilling.

For example, effecting a state of change can include customizing a design of hydraulic fracture per landing zone for purposes of optimization, The customization of a landing zone can depend, at least on part, on the ratio used to characterize the landing zone, the landing zone's parameters, and/or forecasted relative production of water and hydrocarbons. Customization of the landing zone can include, for example and without limitation, quantifying injection needs, such as determining whether there is a need for and a size of an injection well and controlling injection; selecting additives to use for hydraulic fracture, such as clay inhibitors, emulsifiers, and surfactants; and managing waiting times between injection and the start of production to influence imbibition processes.

Figure 4:
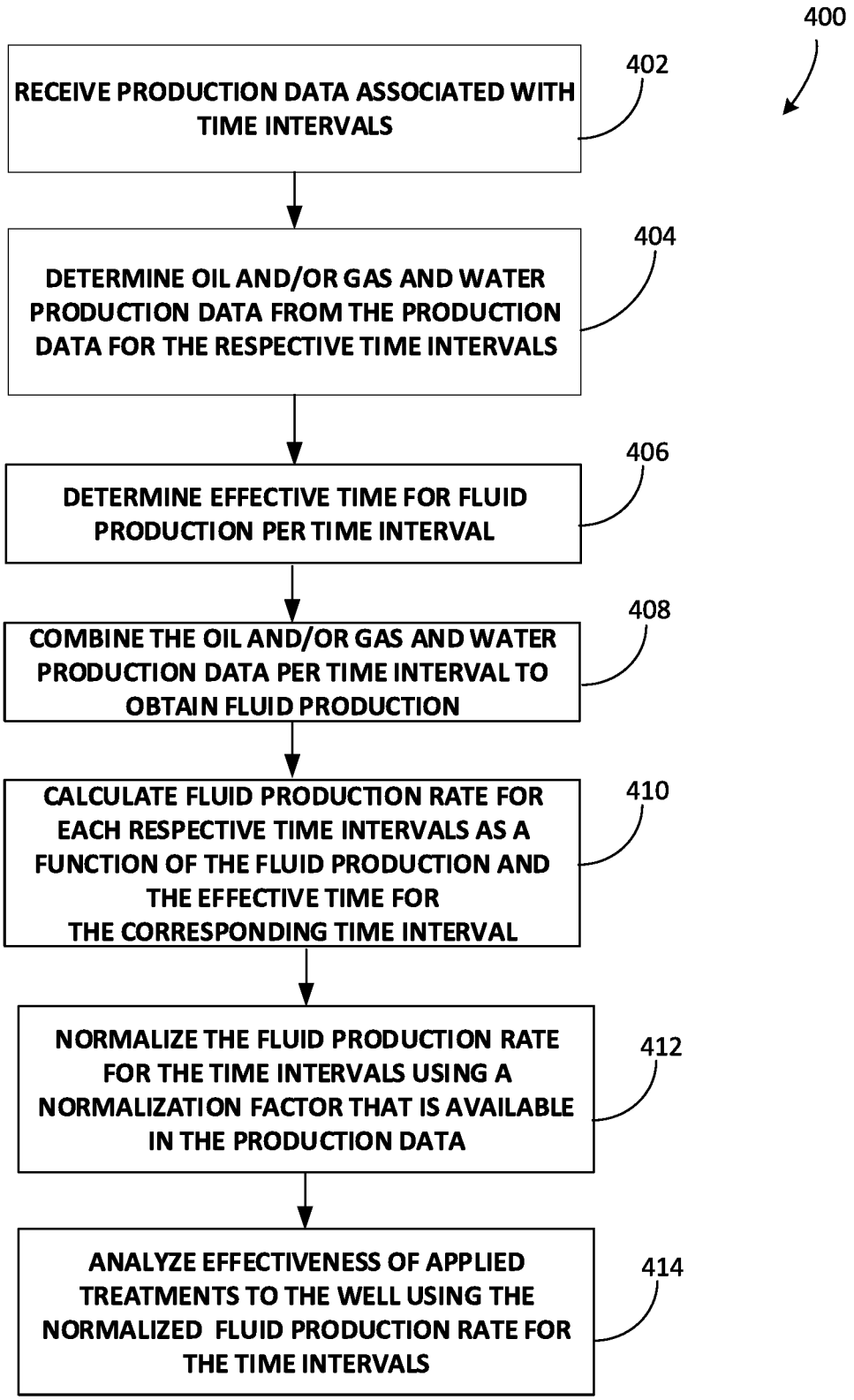
FIGS. 4 and 5 are flowcharts illustrating operations of a method in accordance with embodiments of the present disclosure.
Figure 5:
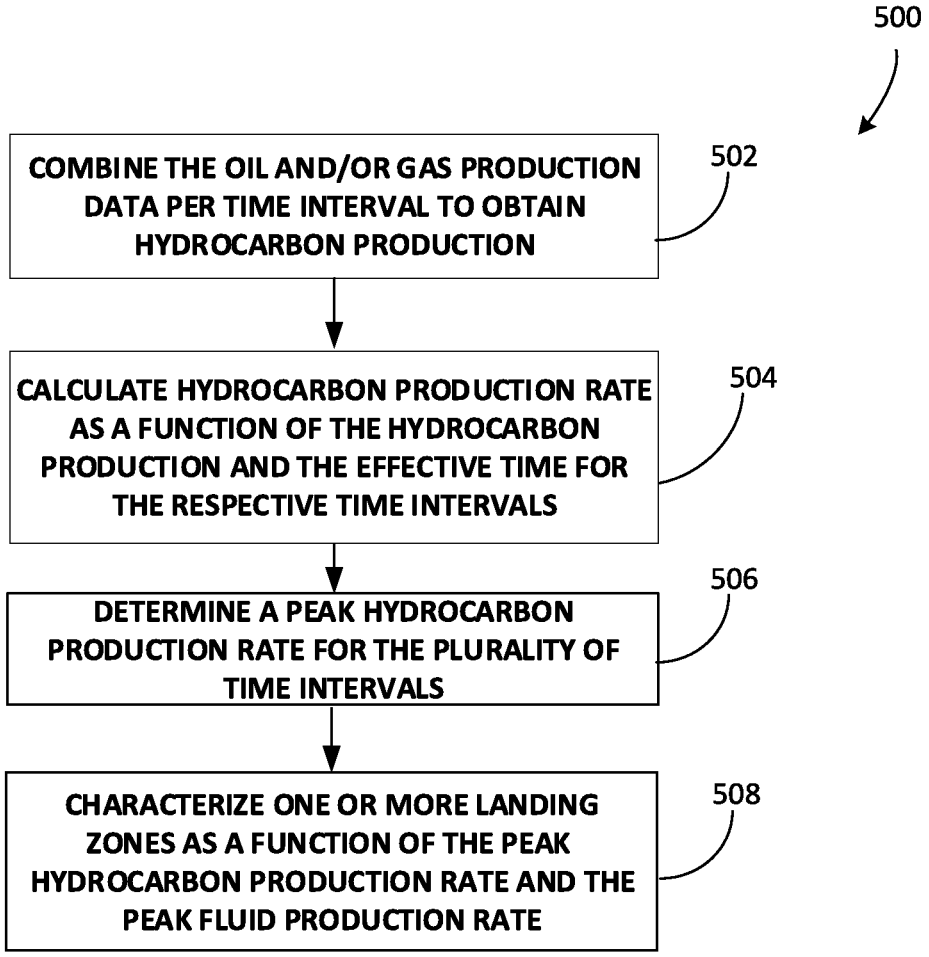

With reference now to FIGS. 4 and 5, shown are flowcharts demonstrating implementation of the various exemplary embodiments with reference to processes 400 and 500. It is noted that the order of operations shown in FIGS. 4 and 5 is not required, so in principle, the various operations may be performed out of the illustrated order. Also certain operations may be skipped, different operations may be added or substituted, or selected operations or groups of operations may be performed in a separate application following the embodiments described herein.

With reference to FIG. 4, process 400 can be performed to analyze effectiveness of applied treatments. Process 400 can be performed as a computer implemented method, such as by PD analysis system 230 (shown in FIG. 2). Starting at operation 402, operation 402 includes receiving production data associated with a plurality of time intervals. The term "receiving" can refer to reading, accessing, receiving a transmission, receiving in response to a request, or otherwise obtaining. The production data can be received from public domain repositories 220, either directly or via an intermediary (not shown). Operation 404 includes determining oil, gas, and/or water production data from the production data for the respective time intervals. For example oil, gas, and/or water data can be extracted from public data 260, e.g., from an appropriate column to public data 260. Operation 404 can include recognizing production data for each of oil, gas, and/or water production, and extracting and storing each of the oil, gas, and/or water production data in association with the respective time intervals.

Operation 406 includes determining effective time for fluid production per time interval of the plurality of time intervals. Operation 406 includes recognizing in the production data, for each time interval, a total amount of time during which fluid was actually being produced. Effective time is reported in the public data 260, e.g., as a data column in public domain monthly production reports. Each well has an effective production time associated with its monthly production.

Operation 408 includes combining the oil, gas, and/or water production data per time interval to obtain total interval fluid production. Operation 408 can include determining the total amount of oil, gas, and/or water produced during the corresponding time interval. Operation 408 can further include converting units used for amounts of one or more of oil, gas, and/or water so that all of the amounts for oil, gas, and/or water are represented using the same units, and then adding the amounts together to obtain the total amount of oil, gas, and/or water produced.

Operation 410 includes calculating fluid production rate for each respective time intervals as a function of the fluid production and the effective time for the corresponding time interval. The fluid production rate can be determined for each time interval as the quotient of the total amount of oil, gas, and/or water produced as determined in operation 408 and the effective time for that time interval as determined in operation 406.

Operation 412 includes normalizing the fluid production rate for the time intervals using a normalization factor that is available in the production data. Operation 412 can include applying a normalization equation to scale the fluid production rate to have a value between 0 and 1, wherein the scaling is based on the normalization factor.

In embodiments, the normalization factor is the peak fluid production rate, in which case the method further includes an operation to determine a peak fluid production rate for the plurality of time intervals by determining or estimating the maximum possible peak fluid production rate. This peak fluid production rate can be included with the production data received at operation 402 or determined by comparing fluid production rates for the respective time intervals. In embodiments, the peak fluid production rate can be interpolated from the fluid production rates associated with the plurality of time intervals.

Operation 414 includes analyzing effectiveness of applied treatments to one or more of the wells using the normalized fluid production rate for the time intervals. Operation 414 can include comparing fluid production rates for different wells and attributing reasons for differences in the fluid production rates. It is appropriate to compare these production rates since they have been normalized. If the production rates were not normalized or using the same standard, then comparison of such production rates would be meaningless.

The fluid production rates can also be ranked to indicate relative productivity of the different wells, wherein ranking is appropriate due to the normalization of the production rates. Once ranked, reasons can be attributed to the differences in the fluid production rates.

Operation 414 can include effecting a state of change in at least one of screening, exploration planning, exploration, and drilling, including interventions, such as stimulation.

With reference to FIG. 5, process 500, which flows from operation 412 (shown in FIG. 4, wherein the normalization factor is determined to be the peak fluid production rate) shown in FIG. 5, can be performed to characterize one or more parameters of landing zones for each of one or more wells. Process 500 can be performed as a computer implemented method, such as by PD analysis system 230 (shown in FIG. 2).

Starting at operation 502, operation 502 includes combining the oil and gas production data per time interval to obtain hydrocarbon production. Operation 502 is similar to operation 408, except that the water production data is not included in the total amount determined for the hydrocarbon production.

Operation 504 includes calculating hydrocarbon production rate as a function of the hydrocarbon production and the effective time for the respective time intervals. The hydrocarbon production rate can be determined for each time interval as the quotient of the total amount of oil and gas produced as determined in operation 502 and the effective time for that time interval as determined in operation 406 (shown in FIG. 4).

Operation 506 includes determining a peak hydrocarbon production rate for the plurality of time intervals. The peak hydrocarbon production rate is determined or estimated to be the maximum peak fluid production rate that can be achieved. This peak hydrocarbon production rate can be included with the production data received at operation 402 (shown in FIG. 4) or determined by comparing hydrocarbon production rates for the respective time intervals. In embodiments, the peak hydrocarbon production rate can be interpolated from the hydrocarbon production rates associated with the plurality of time intervals.

Operation 508 includes characterizing one or more parameters of one or more landing zones associated with the one or more wells as a function of the peak hydrocarbon production rate and the peak fluid production rate. Parameters of landing zones characterized based on the ratio can be determined and analyzed. Analysis can include, for example, determining a range of parameters or a trend of parameters using an offset curve or a cross plot.

Process 500 can further include using the characterization of the one or more parameters to effect a state of change, such as for selecting, guiding, monitoring, and/or controlling application of technologies, methodologies, and/or processes applied to the one or more wells associated with the characterized landing zone(s).

Advantageously, since only a single factor, such as peak fluid production rate, need be determined per well to normalize and standardize the production data, the method for normalizing the production data is scalable over time or number of wells. The normalized production data can then be analyzed to compare production at different wells, analyze effectiveness of technologies, methodologies, or processes applied at the respective wells. Results of analysis based on normalized production rates and/or analysis based on the ratio of peak fluid production rate and peak hydrocarbon production rate can effect a state of change controlling or selecting parameters associated with exploration and/or drilling operations, including interventions, such as stimulation.

In accordance with further aspects of the disclosure, a method implemented by a computer for analyzing effectiveness of applied treatments or characterizing a landing zone is provided. The method includes, for respective one or more wells, receiving production data associated with a plurality of time intervals, determining oil, gas, and/or water production data from the production data per time interval of a plurality of time intervals, and determining an effective fluid production time for production of the oil, gas, and/or water per time interval of the plurality of time intervals. The method further includes combining the oil, gas, and/or water production data per time interval of the plurality of time intervals to obtain a fluid production for the time interval, calculating, per time interval of the plurality of time intervals, a fluid production rate as a function of the effective fluid production time and the fluid production of the time interval, and normalizing the fluid production rate per time interval of the plurality of time intervals using a normalization factor that is available in the production data received. The method further includes, analyzing effectiveness of treatments applied to a well of the respective one or more wells using the well's normalized fluid production rate of the plurality of time intervals.

In embodiments the method can include, for the respective one or more wells, determining a peak fluid production rate of the fluid production rates calculated for the plurality of time intervals, wherein the normalization factor is the peak fluid production rate. In addition or alternatively, the method can include, for the respective one or more wells, converting each of the oil, gas, and/or water production data to common units.

In embodiments the method can include, for the respective one or more wells, combining all of the oil, gas, and/or water production data per time interval of the plurality of time intervals to obtain a total amount of oil, gas, and/or water production data per time interval of the plurality of time intervals. In addition or alternatively, the method can include comparing the normalized fluid production rate associated with the respective one or more wells.

In embodiments, the method can include ranking the normalized fluid production rate associated with the respective one or more wells. In addition or alternatively, the method can include for a well of the respective one or more wells, effecting a state of change based on a result of the comparing.

In embodiments the method can include, for the respective one or more wells, combining the oil and/or gas production data per time interval of the plurality of time intervals to obtain a hydrocarbon production for the interval, calculating, per time interval of the plurality of time intervals, a hydrocarbon production rate as a function of the effective fluid production time and the hydrocarbon production of the time interval, and characterizing parameters of a landing zone associated with a well of the one or more wells as a function of the well's hydrocarbon production rate and fluid production rate calculated for the plurality of time intervals.

In embodiments, the method further includes, for the respective one or more wells, determining at least one of a peak fluid production rate of the fluid production rates and a peak hydrocarbon production rate of the hydrocarbon production rates calculated f for the plurality of time intervals, wherein the parameters of the landing zone are characterized as a function of at least one of the peak hydrocarbon production rate and the peak fluid production rate.

In embodiments, both the peak fluid production rate and the peak hydrocarbon production rate are determined, and the parameters of the landing zone are characterized as a function of a ratio of the peak hydrocarbon production rate and the peak fluid production rate In addition or alternatively, the method can include, for a well of the respective one or more wells, effecting a state of change using the characterization of the parameters of the landing zone.

In accordance with further aspects of the disclosure, a computer system for analyzing effectiveness of applied treatments or characterizing a landing zone is provided. The computer system includes a processor and a memory accessible by the processor. The memory stores instructions that are executable by the processor to instruct the system to, for respective one or more wells, receive production data associated with a plurality of time intervals, determine oil, gas, and/or water production data from the production data per time interval of a plurality of time intervals, determine an effective fluid production time for production of the oil and/or gas and the water per time interval of the plurality of time intervals, combine the oil, gas, and/or water production data per time interval of the plurality of time intervals to obtain a fluid production for the time interval, calculate, per time interval of the plurality of time intervals, a fluid production rate as a function of the effective fluid production time and the fluid production of the time interval, and normalize the fluid production rate per time interval of the plurality of time intervals using a normalization factor that is available in the production data received. The processor is further instructed to analyze effectiveness of treatments applied to a well of the respective one or more wells using the well's normalized fluid production rate of the plurality of time intervals.

In embodiments, the processor is further instructed to, for the respective one or more wells, determine a peak fluid production rate of the fluid production rates calculated for the plurality of time intervals of the plurality of time intervals, wherein the normalization factor is the peak fluid production rate. In addition or alternatively, the processor is further instructed to, wherein the processor is further instructed to, for the respective one or more wells, combine all of the oil, gas, and/or water production data per time interval of the plurality of time intervals.

In embodiments, the processor is further instructed to compare the normalized fluid production rate associated with the respective one or more wells.

In addition or alternatively, the processor is further instructed to, for a well of the respective one or more wells, effect a state of change based on a result of the comparing.

In embodiments, the processor is further instructed to, for the respective one or more wells, combine the oil and/or gas production data per time interval of the plurality of time intervals to obtain a hydrocarbon production for the interval, calculate, per time interval of the plurality of time intervals, a hydrocarbon production rate as a function of the effective fluid production time and the hydrocarbon production of the time interval, and characterize parameters of a landing zone associated with a well of the one or more wells as a function of the well's hydrocarbon production rate and fluid production rate calculated for the plurality of time intervals.

In embodiments, the processor is further instructed to, for the respective one or more wells, determine a peak fluid production rate of the fluid production rates calculated for the plurality of time intervals, and determine a peak hydrocarbon production rate of the hydrocarbon production rates calculated for the plurality of time intervals, wherein the parameters of the landing zone are characterized as a function of the peak hydrocarbon production rate and the peak fluid production rate.

In embodiments, both the peak fluid production rate and the peak hydrocarbon production rate are determined, and the parameters of the landing zone are characterized as a function of a ratio of the peak hydrocarbon production rate and the peak fluid production rate. In addition or alternatively, the processor is further instructed to for a well of the respective one or more wells, effect a state of change using the characterization of the parameters of the landing zone.

In accordance with further aspects of the disclosure, a non-transitory computer-readable medium and one or more computer programs embedded therein are provided. When executed by a computer system, the instructions cause the computer system to for respective one or more wells, receive production data associated with a plurality of time intervals, determine oil, gas, and/or water production data from the production data per time interval of a plurality of time intervals, determine an effective fluid production time for production of the oil, gas, and/or water per time interval of the plurality of time intervals, combine the oil, gas, and/or water production data per time interval of the plurality of time intervals to obtain a fluid production for the time interval, calculate, per time interval of the plurality of time intervals, a fluid production rate as a function of the effective fluid production time and the fluid production of the time interval, and normalize the fluid production rate per time interval of the plurality of time intervals using a normalization factor that is available in the production data received. The instructions further cause the computer system to analyze effectiveness of treatments applied to a well of the respective one or more wells using the well's normalized fluid production rate of the plurality of time intervals.

With certain illustrated embodiments described above, it is to be appreciated that various non-limiting embodiments described herein may be used separately, combined, or selectively combined for specific applications. Further, some of the various features of the above non-limiting embodiments may be used without the corresponding use of other described features. The foregoing description should therefore be considered as merely illustrative of the principles, teachings and exemplary illustrated embodiments of the present disclosure, and not in limitation thereof.

It is to be understood that the above-described arrangements are only illustrative of the application of the principles of the illustrated embodiments. Numerous modifications and alternative arrangements may be devised by those skilled in the art without departing from the scope of the illustrated embodiments, and the appended claims are intended to cover such modifications and arrangements.

What is claimed is:

1. A method, implemented by a computer, comprising:

for respective one or more wells:

receiving production data associated with a plurality of time intervals;

determining oil, gas, and/or water production data from the production data per time interval of a plurality of time intervals;

determining an effective fluid production time for production of the oil, gas, and/or water per time interval of the plurality of time intervals;

combining the oil, gas, and/or water production data per time interval of the plurality of time intervals to obtain a fluid production for the time interval;

calculating, per time interval of the plurality of time intervals, a fluid production rate as a function of the effective fluid production time and the fluid production of the time interval; and normalizing the fluid production rate per time interval of the plurality of time intervals using a normalization factor that is available in the production data received;

analyzing effectiveness of treatments applied to a well of the respective one or more wells using the well's normalized fluid production rate of the plurality of time intervals; and controlling further treatments applied to the well based on the analyzed effectiveness of the treatments applied to the well.

2. The method of claim 1, further comprising, for the respective one or more wells, determining a peak fluid production rate of the fluid production rates calculated for the plurality of time intervals, wherein the normalization factor is the peak fluid production rate.

3. The method of claim 1, further comprising, for the respective one or more wells, converting each of the oil, gas, and/or water production data to common units.

4. The method of claim 1, further comprising, for the respective one or more wells, combining all of the oil, gas, and water production data per time interval of the plurality of time intervals.

5. The method of claim 1, further comprising, comparing the normalized fluid production rate associated with the respective one or more wells.

6. The method of claim 1, further comprising, ranking the normalized fluid production rate associated with the respective one or more wells.

7. The method of claim 5, further comprising, for a well of the respective one or more wells, effecting a state of change based on a result of the comparing.

8. The method of claim 1, further comprising, for the respective one or more wells:

combining the oil and/or gas production data per time interval of the plurality of time intervals to obtain a hydrocarbon production for the interval;

calculating, per time interval of the plurality of time intervals, a hydrocarbon production rate as a function of the effective fluid production time and the hydrocarbon production of the time interval; and characterizing parameters of a landing zone associated with a well of the one or more wells as a function of the well's hydrocarbon production rates and fluid production rates calculated for the plurality of time intervals.

9. The method of claim 8, further comprising, for the respective one or more wells, determining at least one of a peak fluid production rate of the fluid production rates and a peak hydrocarbon production rate of the hydrocarbon production rates calculated for the plurality of time intervals, wherein the parameters of the landing zone are characterized as a function of at least one of the peak hydrocarbon production rate and the peak fluid production rate.

10. The method of claim 9, wherein both the peak fluid production rate and the peak hydrocarbon production rate are determined, and the parameters of the landing zone are characterized as a function of a ratio of the peak hydrocarbon production rate and the peak fluid production rate.

11. The method of claim 8, further comprising, for a well of the respective one or more wells, effecting a state of change using the characterization of the parameters of the landing zone.

12. A computer system comprising:

a processor;

a memory accessible by the processor;

instructions stored in the memory and executable by the processor to instruct the system to:

for respective one or more wells:

receive production data associated with a plurality of time intervals;

determine oil, gas, and/or water production data from the production data per time interval of a plurality of time intervals;

determine an effective fluid production time for production of the oil, gas, and/or water per time interval of the plurality of time intervals;

combine the oil, gas, and/or water production data per time interval of the plurality of time intervals to obtain a fluid production for the time interval;

calculate, per time interval of the plurality of time intervals, a fluid production rate as a function of the effective fluid production time and the fluid production of the time interval; and normalize the fluid production rate per time interval of the plurality of time intervals using a normalization factor that is available in the production data received;

analyze effectiveness of treatments applied to a well of the respective one or more wells using the well's normalized fluid production rate of the plurality of time intervals; and control further treatments applied to the well based on the analyzed effectiveness of the treatments applied to the well.

13. The computer system of claim 12, wherein the processor is further instructed to, for the respective one or more wells, determine a peak fluid production rate of the fluid production rates calculated for the plurality of time intervals, wherein the normalization factor is the peak fluid production rate.

14. The computer system of claim 12, wherein the processor is further instructed to, for the respective one or more wells, combine all of the oil, gas, and/or water production data per time interval of the plurality of time intervals to obtain the time interval's fluid production data.

15. The computer system of claim 12, wherein the processor is further instructed to, compare the normalized fluid production rate associated with the respective one or more wells.

16. The computer system of claim 15, wherein the processor is further instructed to, for a well of the respective one or more wells, effect a state of change based on a result of the comparing.

17. The computer system of claim 12, wherein the processor is further instructed to, for the respective one or more wells:

combine the oil and/or gas production data per time interval of the plurality of time intervals to obtain a hydrocarbon production for the interval;

calculate, per time interval of the plurality of time intervals, a hydrocarbon production rate as a function of the effective fluid production time and the hydrocarbon production of the time interval; and characterize parameters of a landing zone associated with a well of the one or more wells as a function of the well's hydrocarbon production rate and fluid production rate calculated for the plurality of time intervals.

18. The computer system of claim 17, the processor is further instructed to, for the respective one or more wells:

determine a peak fluid production rate of the fluid production rates calculated for the plurality of time intervals; and determine a peak hydrocarbon production rate of the hydrocarbon production rates calculated for the plurality of time intervals, wherein the parameters of the landing zone are characterized as a function of the peak hydrocarbon production rate and the peak fluid production rate.

19. The computer system of claim 18, wherein the processor is further instructed to, for a well of the respective one or more wells, effect a state of change using the characterization of the parameters of the landing zone.

20. A non-transitory computer readable storage medium and one or more computer programs embedded therein, the computer programs comprising instructions, which when executed by a computer system, cause the computer system to:

for respective one or more wells:

receive production data associated with a plurality of time intervals;

determine oil, gas, and/or water production data from the production data per time interval of a plurality of time intervals;

determine an effective fluid production time for production of the oil, gas, and/or water per time interval of the plurality of time intervals;

combine the oil, gas, and/or water production data per time interval of the plurality of time intervals to obtain a fluid production for the time interval;

calculate, per time interval of the plurality of time intervals, a fluid production rate as a function of the effective fluid production time and the fluid production of the time interval; and normalize the fluid production rate per time interval of the plurality of time intervals using a normalization factor that is available in the production data received;

analyze effectiveness of treatments applied to a well of the respective one or more wells using the well's normalized fluid production rate of the plurality of time intervals; and control further treatments applied to the well based on the analyzed effectiveness of the treatments applied to the well.

* * * * *